US005993294A

United States Patent [19]

Gottschald

[11] Patent Number: 5,993,294

[45] Date of Patent: Nov. 30, 1999

[54] METHOD AND SPECTACLE LENS GRINDING MACHINE FOR SHAPE GRINDING THE CIRCUMFERENTIAL EDGE OF SPECTACLE LENSES AND OPTIONALLY FOR SUBSEQUENTLY GRINDING A FACET

[75] Inventor: Lutz Gottschald, Meerbusch, Germany

[73] Assignee: Wernicke & Co. GmbH, Düsseldorf, Germany

[21] Appl. No.: 08/846,133

[22] Filed: Apr. 25, 1997

[30] Foreign Application Priority Data

Apr. 25, 1996 [DE] Germany ..... 196 16 536

[51] Int. Cl.[6] ..... B24B 49/00

[52] U.S. Cl. ..... 451/43; 451/42; 451/255; 451/256

[58] Field of Search ..... 451/42, 43, 54, 451/255, 256, 240

[56] References Cited

U.S. PATENT DOCUMENTS

| | | | |
|---|---|---|---|
| 3,590,532 | 7/1971 | Littlefield . | |
| 3,798,844 | 3/1974 | Hannaman . | |
| 3,899,851 | 8/1975 | Asselin et al. . | |
| 4,217,736 | 8/1980 | Akaba et al. . | |
| 4,557,076 | 12/1985 | Helbrecht . | |
| 4,633,618 | 1/1987 | Kobayashi . | |
| 4,637,168 | 1/1987 | Kotting et al. . | |
| 5,148,637 | 9/1992 | Byron . | |
| 5,347,762 | 9/1994 | Shibata et al. | 451/15 |
| 5,630,746 | 5/1997 | Gottschald et al. | 451/5 |

FOREIGN PATENT DOCUMENTS

| | | |
|---|---|---|
| 0096337 | 12/1983 | European Pat. Off. . |
| 4027574 | 4/1991 | Germany . |

*Primary Examiner*—Eileen P. Morgan
*Attorney, Agent, or Firm*—Robert W. Becker & Associates

[57] ABSTRACT

In a method for shape grinding a circumferential edge of a spectacle lens, and optionally subsequently facet grinding, in a lens grinding machine that comprises a lens securing shaft and a grinding wheel moveable in a controlled manner relative to the lens securing shaft, the grinding pressure is increased for a decreasing radius of the spectacle lens measured from the rotational axis of a lens securing shaft to a respective contacting location of the spectacle lens at the grinding wheel. The spectacle lens grinding machine for performing the method includes a machine frame, a lens securing shaft and a grinding wheel rotatably supported in the machine frame, a control motor connected to the machine frame for advancing the grinding wheel toward the lens securing shaft, and a computer for controlling the control motor. A travel sensor for detecting the advancing stroke of the grinding wheel toward the lens securing shaft is provided. The travel sensor includes a data transmitting line to the computer. The grinding pressure is computer-controlled based on the radius at the contacting location at the grinding wheel and data transmitted by the travel sensor. The grinding pressure is changed by changing the torque of the control motor.

14 Claims, 1 Drawing Sheet

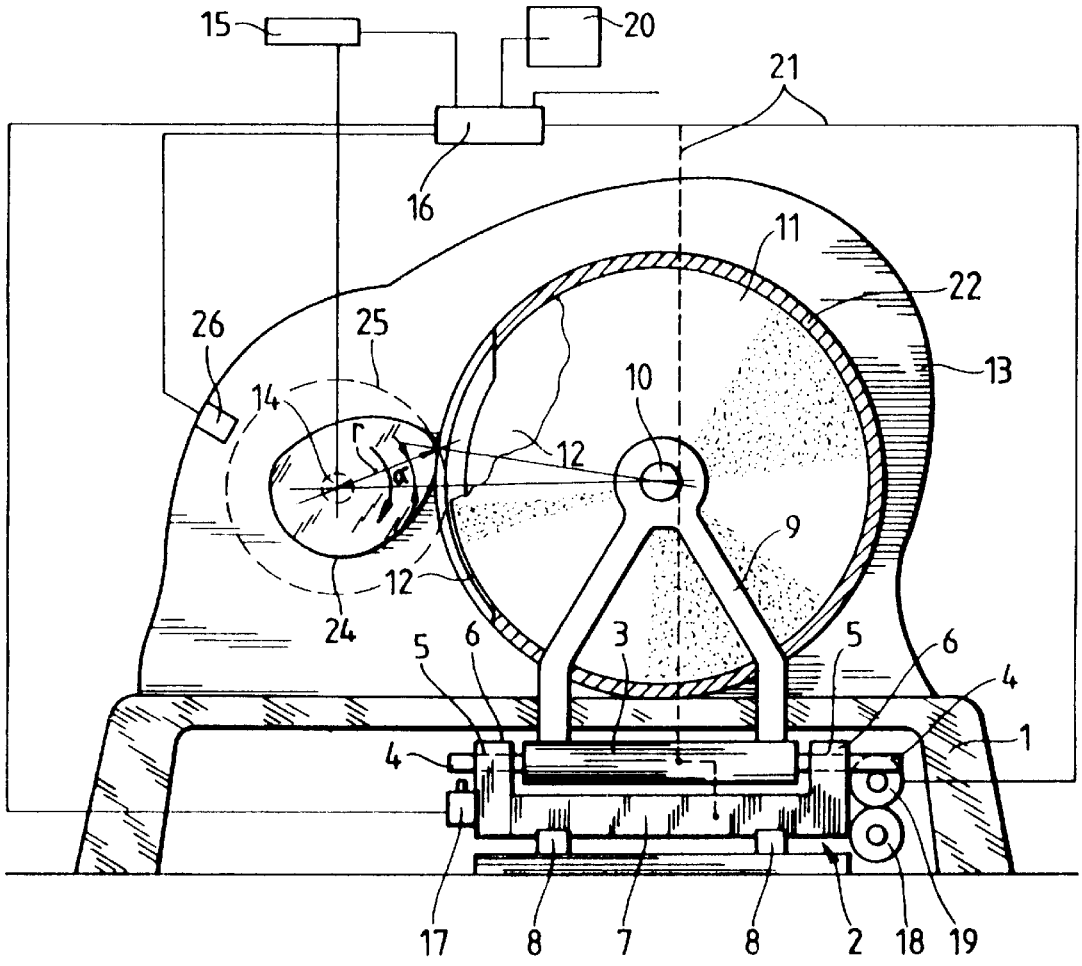
15
20
21
16
11
22
26
25
13
10
14
12
9
12
24
5
6
3
5
6
4
1
4
17
8
7
8
2
18
19

METHOD AND SPECTACLE LENS GRINDING MACHINE FOR SHAPE GRINDING THE CIRCUMFERENTIAL EDGE OF SPECTACLE LENSES AND OPTIONALLY FOR SUBSEQUENTLY GRINDING A FACET

BACKGROUND OF THE INVENTION

The invention relates to a method and a spectacle lens grinding machine for shape grinding the circumferential edge of spectacle lenses and optionally for subsequently grinding a facet with a spectacle lens grinding machine comprising a spectacle lens securing shaft for securing the spectacle lens and a grinding wheel that is controllably moveable relative to the lens securing shaft.

In order to perform the shape grinding of the circumferential edge of spectacle lenses and the subsequent facet grinding as fast as possible, the grinding pressure for a rpm of the grinding wheel selected as high as possible is adjusted to a value which allows grinding the desired shape of a spectacle lens starting from a circular lens blank into without damaging or even destroying the spectacle lens.

For a fixedly adjusted grinding pressure it may occur that the torque acting during grinding onto the spectacle lens blank is greater than the securing force for clamping the lens blank at the securing shaft so that the spectacle lens blank may be rotated relative to the securing shaft. Such a rotation, when a spherical spectacle lens without reading glass portion is ground, is of minimal impact when no displacement of the focal point of the lens blank from the axis of rotation of the securing shaft occurs; however, such a rotation should not occur at all when the lens blank has a precisely angularly arranged reading glass portion relative to the optical axis of the lens blank or is to be provided with a cylindrical or prismatic ground portion whose axis position relative to the arrangement of the spectacle lens within the spectacle frame is predetermined.

A rotation of the spectacle lens blank within the securing shaft can occur especially when spectacle lenses with a highly anti-reflective coating are machined because these lenses have an especially low frictional coefficient relative to the securing devices at the securing shaft or attached holding blocks or suction devices.

When the grinding pressure is decreased to such an extent that a rotation of the lens blank on the securing shaft can be prevented with certainty, the machining time of the lens blank will increase and the output of the spectacle lens grinding machine is thus reduced. A change of the grinding pressure as a function of the width of the edge of the spectacle lens such that the grinding pressure is increased when the width of the lens blank is greater and is lowered when the width of the lens blank is smaller, is known from European Patent Application 0 096 337. However, this type of controlling of the grinding pressure leads to the grinding pressure being greatest for myopic lenses when the radius of the spectacle lens is greatest and to grinding pressure becoming smaller and smaller with decreasing radius of the spectacle lens, while this known control for hyperopic lenses has the opposite effect. With this kind of control and the grinding pressure a slipping of the spectacle lens of the securing shaft due to the grinding pressure can only be avoided when for myopic lenses the grinding pressure at the greatest radius of the spectacle lens is adjusted to a value that prevents slipping which means that with a radius that decreases the grinding pressure is to be decreased also so that overall the machining time is increased. This disadvantage does not occur for grinding of hyperopic lenses; however, the grinding pressure controlled based on the width of the spectacle lens is not always optimized.

It is therefore an object of the present invention to provide a method and a spectacle lens grinding machine for shape grinding the circumferential edge of spectacle lenses and for an optional subsequent facet grinding step with which a slipping of the spectacle lens secured on the securing shaft can be reliably prevented and with which the grinding of the circumferential edge of the spectacle lens can be performed as quickly as possible without running the risk of breaking or damaging the spectacle lens.

SUMMARY OF THE INVENTION

The method for shape grinding a circumferential edge of a spectacle lens, and optionally subsequently grinding a facet, on a lens grinding machine that comprises a lens securing shaft and a grinding wheel moveable in a controlled manner relative to the lens securing shaft, according to the present invention is primarily characterized by:

Controlling a grinding pressure such that for a decreasing radius of the spectacle lens, measured from a rotational axis of the lens securing shaft to a respective contacting location of the spectacle lens at the grinding wheel, the grinding pressure is increased.

Preferably, the method further includes the step of determining an angle between the radius of the spectacle lens at the contacting location and a straight line connecting the rotational axis of the lens securing shaft and the rotational axis of the grinding wheel, wherein the step of controlling includes increasing the grinding pressure when the angle increases in a direction of rotation of the grinding wheel.

The method further includes the step of determining the angle between the radius the spectacle lens at the contacting location and a straight line connecting the rotational axis of the lens securing shaft and the rotational axis of the grinding wheel, wherein the step of controlling includes increasing the grinding pressure when the angle increases counter to a direction of rotation of the grinding wheel.

Advantageously, the method further includes the step of determining a width of the lens edge of the spectacle lens at the contacting location, wherein the step of controlling includes increasing the grinding pressure when the width increases and decreasing the grinding pressure when the width decreases.

Preferably, in the step of controlling, the grinding pressure is increased from the lowest value of 30N, when the radius is 40 mm, to a highest value of 60N, when the radius is 8 mm.

The method may further include the step of providing an oscillating component to the actual grinding pressure.

Advantageously, the amplitude of the oscillating component is approximately 20% of the grinding pressure.

The frequency of the oscillating component is approximately 50 per second (50 $s^{-1}$) of the grinding pressure.

Advantageously, the absolute value of the grinding pressure during shape grinding is different from the grinding pressure during facet grinding and the absolute value of the grinding pressure is increased with decreasing radius.

The absolute values of the grinding pressure and/or the increase of the grinding pressure with decreasing radius are different for spectacle lenses consisting of silicate then for spectacle lenses consisting of plastic.

The step of controlling employs a computer and the computer contains a set of data for controlling the shape grinding of the spectacle lens, wherein the set of data also controls the grinding pressure.

The inventive spectacle lens grinding machine for performing the inventive method is preferably characterized by:

A machine frame;

A lens securing shaft rotatably supported in the machine frame;

A grinding wheel rotatably supported in the machine frame;

A control motor connected to the machine frame for advancing the grinding wheel toward the lens securing shaft;

A computer for controlling the control motor;

A travel sensor for detecting an advancing stroke of the grinding wheel toward the lens securing shaft;

The travel sensor including a data transmitting line connected to the computer;

Wherein the grinding pressure is controlled by the computer based on a radius of the contacting location of the spectacle lens at the grinding wheel and data transmitted by the travel sensor;

Wherein the grinding pressure is changed by changing a torque of the control motor.

Preferably, the control motor is torque-controlled.

The spectacle lens grinding machine further comprises a torque-controlled coupling connected between the control motor and the grinding wheel.

The coupling is preferably a magnetic particle coupling.

The spectacle lens grinding machine further comprises a pickup for measuring the width of a spectacle lens mounted on the lens securing shaft at contacting location of the grinding wheel and a data transmitting line connecting the pickup and the computer. The grinding pressure is preferably controlled based on the measured width of the spectacle lens at the contacting location.

According to the inventive method, the grinding pressure is thus adjusted in a controlled manner as a function of the respective radius at the contact location of the spectacle lens at the grinding wheel when the radius decreases.

The grinding pressure is adjusted such that for a great radius at the contacting location at the grinding wheel it is such a value that a slipping of the spectacle lens secured at the lens securing shaft is prevented, but the grinding pressure is increased with decreasing radius whereby the increase, on the one hand, depends on the actually occurring torque resulting from the grinding pressure applied onto the spectacle lens blank but, on the other hand, may not be so great that damage or destruction of the lens blank could occur.

The control of the grinding pressure as a function of the radius at the contacting location at the grinding wheel can be further improved when for the control of the grinding pressure additionally the angle between the radius of the actual contacting location of the spectacle lens at the grinding wheel and a straight line, connecting the rotational axis of the lens securing shaft and of the grinding wheel, is applied such that the grinding pressure is increased for an increasing angle counter to or in the rotational direction of the grinding wheel. With this changing angle not only the radius of the spectacle lens blank changes but also the effective direction of the grinding force, i.e., a decrease of the torque acting on the spectacle lens for an increasing angle.

With the inventive method it is also possible to take into consideration the width of the edge of the spectacle lens in the area of the contacting location at the grinding wheel. An increase of the grinding pressure for increasing edge width and a decrease of the grinding pressure for a reduced edge width is performed, but under the condition that the grinding pressure for a greater edge width and a greater radius is not adjusted to such a great value that a slipping of the spectacle lens at the securing shaft would occur.

Tests have shown that it is sufficient to provide a lowest possible grinding pressure for a lens radius of approximately 40 mm of approximately 30N, while the highest possible grinding pressure of approximately 60N can be applied for a spectacle lens radius of approximately 8 mm. This increase can be performed linearly or, as previously mentioned, modulated as a function of the angle between the radius at the actual contacting location of the lens blank at the grinding wheel and the straight line connecting the axis of rotation of the securing shaft and the grinding wheel and/or the edge width of the spectacle lens in the area of the contacting point of the lens blank at the grinding wheel.

An additional modulation of the actual grinding pressure is possible by superimposing an oscillating component. With this measure the machining speed can be increased without running the risk of slipping, damaging, or breaking of the spectacle lens.

The amplitude of the oscillating component of the grinding pressure can be approximately 20% of the grinding pressure and can be adjusted as a function of the previously mentioned parameters.

Advantageously, the frequency of the oscillating component can be approximately 50 per second (50 $s^{-1}$).

A further advantageous possibility of modulating the grinding pressure is as follows. The absolute value of the grinding pressure during shape grinding of the spectacle lens with a cylindrical grinding wheel is selected differently than the grinding pressure for the subsequent facet grinding step with a grinding wheel having a facet groove, whereby this absolute value can be increased according to the decreasing radius while the absolute value of the grinding pressure during facet grinding can be advantageously adjusted to be smaller because facet grinding, in general, is a finishing the fine machining process.

Furthermore, the absolute values of the actual grinding pressure and/or the increase of the grinding pressure for a decreasing radius can be different for spectacle lenses consisting of silicate than for spectacle lenses consisting of plastic material.

The inventive control of the grinding pressure can be performed especially easily with a set of data stored in a computer, which also controls the shape grinding of the spectacle lens with the same set of data.

The inventive spectacle lens grinding machine for performing the inventive method includes a lens securing shaft for securing the spectacle lens blank and a grinding wheel than can be advanced with a computer-controlled electric control motor toward the lens securing shaft. The grinding machine further comprises a travel sensor for detecting the travel stroke of the advancing grinding wheel toward the securing shaft. The sensor is connected to the computer so that the data, detected by the travel sensor and transmitted to the computer, together with the respective rotational angle of the spectacle lens can be computed and processed into a control signal for controlling the grinding pressure as a function of the actual radius of the spectacle lens at the contact location at the grinding wheel, whereby the control of the grinding pressure is effected by changing the torque transmitted by the control motor. The change of torque can be performed either with a torque-controlled control motor or with a torque-controlled coupling (clutch) between the control motor and the advanceable grinding wheel.

Preferably, a magnetic particle coupling is used which allows for an especially simple control of the torque to be transmitted as a function of the supplied voltage.

A similar embodiment is provided when a pickup (sensor) for the width of the spectacle lens is provided which is also connected to the computer. The measured width values are used for controlling the grinding pressure as a function of the actual width of the spectacle lens at the contacting location at the grinding wheel.

BRIEF DESCRIPTION OF THE DRAWINGS

The object and advantages of the present invention will appear more clearly from the following specification in conjunction with the accompanying only drawing showing a schematic side view, partly in section, of the inventive lens grinding machine.

DESCRIPTION OF PREFERRED EMBODIMENTS

The present invention will now be described in detail with aid of a specific embodiment utilizing the only Figure.

A cross carriage 2 is arranged on a machine frame 1 and has a carriage part 3 with guide rods 4 which are guided in bores 5 of projections 6 of the carriage part 7 so as to be radially displaceable relative to a lens securing shaft 14 for securing the lens blank 25 to be ground. The carriage part 7 is arranged on guide rails 8 so as to be parallel to the lens securing shaft 14 and a shaft 10 for a pregrinding wheel 11 and a coaxially arranged finishing and/or facet grinding wheel 12.

The shaft 10 is supported with bearing supports 9 at the carriage part 3. The grinding wheels 11, 12 and the spectacle lens blank 25 together with their shafts 10, 14 are surrounded by a housing 13 that has at its bottom a non-represented basin that prevents cooling liquid and grinding dust from reaching the area of the cross carriage 2.

An angle transducer 15 is connected to the securing shaft 14 and is connected to computer 16. A travel sensor 17 is arranged at the carriage part 7 for detecting the radial displacement of the carriage part 3 relative to the lens securing shaft 14. This travel sensor 17 is also connected to the computer 16. The radial displacement of the carriage part 3 and thus the advancement of the grinding wheels 11, 12 toward the spectacle lens blank 25 is effected by a control motor 18 that is controlled by the computer 16 via control lines 21. The control motor 18 is in driving connection with the guide rods 4 via a magnetic particle coupling 19.

A nominal value memory 20 can be provided with data sets for the circumferential contours of different spectacle lens shapes in the form of polar coordinates. These sets of data can be used for controlling the shape grinding of the spectacle lens 25.

For grinding a predetermined contour 24 of the spectacle lens, a substantially circular spectacle lens blank 25 is clamped within the lens securing shaft 14 and is contacted with the pregrinding wheel 11. The occurring grinding pressure results from the torque of the magnetic particle coupling 19 that is produced by the computer 16 supplying a voltage corresponding to the desired torque onto the magnetic particle coupling 19.

The lens securing shaft 14 with the lens blank 25 clamped therein is rotated in a manner known per se whereby the rotational velocity is conventionally approximately 10 to 13 rpm. The angle transducer 15 transmits the computer 16 impulses at equidistant angular values, for example, in increment of respectively 6 degrees, so that the computer 16 is actuated to adjust the corresponding radius to be ground of the circumferential contour 24 via the control motor 18.

During grinding of the circumferential contour 24 with the pregrinding wheel 11, the carriage part 7 and thus the grinding wheel 11 are moved in an oscillating movement parallel to the axis of rotation of the lens blank 25 which is respectively redirected in the opposite direction at the edge of the pregrinding wheel 11. This oscillating movement is controlled by a non-represented drive for the carriage part 7 which is also connected to the computer 16.

This controlling action can be actuated by a pickup 26 connected to the computer 16 and arranged within the housing 13 whereby this pickup 26 simultaneously measures the width of the oppositely arranged edge of the lens blank 25, respectively, of the contour of the lens 24.

Since the computer 16 has at its disposal radius values r for the points of the spectacle lens 24 contacting the grinding wheel that are saved in a memory, or can be derived from the data supplied by the sensor 17, the computer 16 can be programmed such that it will send control signals to the magnetic particle coupling 19 for controlling the grinding pressure as a function of the radius r such that it is increased when the radius changes to a smaller radius. The grinding pressure can be adjusted from a minimum value of approximately 30N for a radius of 40 mm to a maximum value of approximately 60N for a radius of approximately 8 mm.

Since the contacting location of the shape-ground spectacle lens contour 24 at the grinding wheel 11, 12 with radius r is displaced relative to the straight line connecting the securing shaft 14 and the shaft 10 thus changing the angle $\alpha$, the line of action of the circumferential force, resulting from the grinding pressure and acting onto the spectacle lens 24, as well as the torque acting on the spectacle lens 24 also change. This can be taken into consideration such that the grinding pressure is increased when the angle $\alpha$ between the radius at the actual contacting location of the spectacle lens 24 at the grinding wheel 11, 12 and the straight line connecting the axes of rotation of the securing shaft 14 and of the grinding wheel shaft 10 when the angle $\alpha$ increases counter to or in the rotation direction.

Furthermore, the edge width of the spectacle lens 24 in the area of the contacting point at the grinding wheel 11, 12 can be employed such that the grinding pressure is increased with increasing edge width and decreased with decreasing edge width, when the respective edge width is measured with the pickup 26 and supplied to the computer 16.

When employing the angle $\alpha$ and the respective edge width of the spectacle lens within the grinding area, the machining speed can be optimized and adjusted to the respective spectacle lens to be machined depending on whether a myopic or hyperopic glass is being ground and whether the spectacle lens is to be provided with a cylindrical or prismatic ground portion.

The machining speed can also optionally be further improved when the actual grinding pressure has superimposed oscillating component with an amplitude which is approximately 20% of the grinding pressure. The frequency of the oscillating component can be approximately 50 per second (50 $s^{-1}$).

Furthermore, it is advantageous when the grinding pressure during shape grinding of the spectacle lens blank 25 by the pregrinding wheel 11 is adjusted differently than the grinding pressure for the subsequent fine or facet grinding step at the fine grinding wheel 12, i.e., the grinding pressure is reduced to a smaller value during fine or facet grinding in order to produce during this fine grinding step a surface as precise and smooth as possible.

This adjustment of the grinding pressure is performed in an automatic and computer-controlled manner during repositioning of the lens blank 24 from the pregrinding wheel 11 onto the fine or facet grinding wheel 12.

Furthermore, different grinding pressures and/or a different increase of the grinding pressure as a function of the grinding radius of the spectacle lens can be input into the computer 16 for different materials of the spectacle lens, i.e., depending on whether it is made of silicate or of plastic.

In the represented embodiment, between the control motor 18 and the drive for the carriage part 3 a magnetic particle coupling 19 is arranged because the torque to be transmitted can be adjusted especially precisely with a magnetic particle coupling. However, it is also possible to eliminate a magnetic particle coupling or any other torque-transmitting coupling when the control motor 18 allows for a torque control. In this case, the torque generated by the control motor 18 is controlled by the computer 16 directly as a function of the required grinding pressure.

The present invention is, of course, in no way restricted to the specific disclosure of the specifications, and drawings, but also encompasses any modifications within the scope of the appended.

What I claim is:

1. A method for shape grinding a circumferential edge of a spectacle lens and, optionally, subsequent facet grinding, on a lens grinding machine that comprises a lens securing shaft and a grinding wheel moveable in a controlled manner relative to the lens securing shaft, said method comprising the step of:

controlling a grinding pressure such that for a decreasing radius of the spectacle lens, measured from a rotational axis of the lens securing shaft to a respective contacting location of the spectacle lens at the grinding wheel, the grinding pressure is increased.

2. A method according to claim 1, further including the step of determining an angle between the radius of the spectacle lens at the contacting location and a straight line connecting the rotational axis of the lens securing shaft and the rotational axis of the grinding wheel, wherein said step of controlling includes increasing the grinding pressure when the angle increases in a direction of rotation of the grinding wheel.

3. A method according to claim 1, further including the step of determining an angle between the radius of the spectacle lens at the contacting location and a straight line connecting the rotational axis of the lens securing shaft and the rotational axis of the grinding wheel, wherein said step of controlling includes increasing the grinding pressure when the angle increases counter to a direction of rotation of the grinding wheel.

4. A method according to claim 1, further including the step of determining a width of the lens edge of the spectacle lens at the contacting location, wherein said step of controlling includes increasing the grinding pressure when the width increases and decreasing the grinding pressure when the width decreases.

5. A method according to claim 1, wherein in said step of controlling the grinding pressure is increased from a lowest value of 30N, when the radius is 40 mm, to a highest value of 60N, when the radius is 8 mm.

6. A method according to claim 1, further including the step of providing an oscillating component to the actual grinding pressure.

7. A method according to claim 6, wherein an amplitude of the oscillating component is approximately 20% of the grinding pressure.

8. A method according to claim 6, wherein a frequency of the oscillating component is approximately 50 $s^{-1}$ of the grinding pressure.

9. A method according to claim 1, wherein the absolute value of the grinding pressure during shape grinding is different from the grinding pressure during facet grinding and wherein the absolute value of the grinding pressure is increased with decreasing radius.

10. A method according to claim 1, wherein absolute values of the grinding pressure and the increase of the grinding pressure with decreasing radius are different for spectacle lenses consisting of silicate than for spectacle lenses consisting of plastic.

11. A method according to claim 1, wherein absolute values of the grinding pressure with decreasing radius are different for spectacle lenses consisting of silicate than for spectacle lenses consisting of plastic.

12. A method according to claim 1, wherein the increase of the grinding pressure with decreasing radius is different for spectacle lenses consisting of silicate than for spectacle lenses consisting of plastic.

13. A method according to claim 1, wherein the step of controlling employs a computer and wherein the computer contains a set of data for controlling the shape grinding of the spectacle lens and wherein the set of data also controls the grinding pressure.

14. A method for shape grinding a circumferential edge of a spectacle lens and, optionally, subsequent grinding, on a lens grinding machine that comprises a lens securing shaft and a grinding wheel moveable in a controlled manner relative to the lens securing shaft, said method comprising the step of:

controlling a grinding pressure such that for a decreasing radius of the spectacle lens, measured from a rotational axis of the lens securing shaft to a respective contacting location of the spectacle lens at the grinding wheel, the grinding pressure is increased and such that for an increasing radius of the spectacle lens, measured from a rotational axis of the lens securing shaft to a respective contacting location of the spectacle lens at the grinding wheel, the grinding pressure is dereased.

* * * * *